United States Patent [19]

Omura

[11] Patent Number: 4,502,671

[45] Date of Patent: Mar. 5, 1985

[54] BATCH ANNEALING APPARATUS

[75] Inventor: Kiyoharu Omura, Kitakyushu, Japan

[73] Assignee: Nippon Steel Corporation, Tokyo, Japan

[21] Appl. No.: 542,193

[22] Filed: Oct. 14, 1983

[30] Foreign Application Priority Data

| | | | |
|---|---|---|---|
| Oct. 30, 1982 | [JP] | Japan | 57-190035 |
| Dec. 9, 1982 | [JP] | Japan | 57-214692 |
| Mar. 24, 1983 | [JP] | Japan | 58-48007 |
| Mar. 24, 1983 | [JP] | Japan | 58-41289[U] |
| Mar. 24, 1983 | [JP] | Japan | 58-41290[U] |

[51] Int. Cl.[3] ..... F27B 11/00; C21D 9/663

[52] U.S. Cl. ..... 266/256; 266/259; 266/263; 432/206

[58] Field of Search ..... 266/256, 262, 269, 253, 266/252; 432/206, 260, 254.1, 254.2

[56] References Cited

U.S. PATENT DOCUMENTS

| | | | |
|---|---|---|---|
| 1,541,691 | 6/1925 | Duckhan | 266/256 |
| 2,050,029 | 8/1936 | Williams | 266/264 |
| 2,081,990 | 6/1937 | Eberwein | 266/256 |
| 4,287,940 | 9/1981 | Corbett, Jr. | 165/48 R |

FOREIGN PATENT DOCUMENTS

| | | | |
|---|---|---|---|
| 894622 | 1/1983 | Belgium . | |
| 480691 | 8/1929 | Fed. Rep. of Germany . | |
| 851812 | 10/1952 | Fed. Rep. of Germany . | |
| 2079314 | 1/1982 | United Kingdom . | |
| 515808 | 6/1976 | U.S.S.R. | 266/256 |

*Primary Examiner*—L. Dewayne Rutledge
*Assistant Examiner*—Christopher W. Brody
*Attorney, Agent, or Firm*—Wenderoth, Lind & Ponack

[57] ABSTRACT

A batch annealing apparatus comprises a bell-shaped furnace, a base plate, an inner cover, plus a bottom chamber that opens upward, has an inside diameter slightly larger than the outside diameter of a metal coil to be treated therein, is capable of accommodating the metal coil, and disposed below the furnace. A cylindrical stationary base coaxially extends upward from the bottom of the bottom chamber. The stationary base has a partition with an outside diameter slightly smaller than the inside diameter of the metal coil that is formed at a point corresponding to the opening of the bottom chamber. The base plate is annular in shape, equipped with cooling means, and supported by elevatable supporting means that passes through the bottom of the bottom chamber. The lower end of the supporting means is connected to an elevating device.

9 Claims, 15 Drawing Figures

BATCH ANNEALING APPARATUS

BACKGROUND OF THE INVENTION

This invention relates to a batch annealing apparatus for metal coils, and more particularly to a batch annealing apparatus that heats metal coils in such a manner that all portions across the width or length of the coil pass through a specific temperature range at a predetermined temperature gradient.

Conventional metal coil annealing furnaces in common use anneal a stationary coil placed on the base plate by applying a given heat pattern. In the manufacture of unidirectional electrical steels, for example, batch annealing furnaces of the type as shown in FIG. 1 are in wide use for finish annealing (secondary recrystallization annealing).

That is to say, a coil of electrical steel C is placed, with the axis thereof vertical, on a base plate 3, and an inner cover 2 is placed over the coil, as shown in FIG. 1. With a bell-shaped furnace 1 lowered over the inner cover 2, $N_2$, AX, $H_2$ or other atmosphere gas is supplied into the space under the inner cover 2 through a feed pipe 4. An electric heater 5 on the inside of the furnace 1 and an electric heater 6 below the base plate 3 are then turned on to simultaneously heat all parts of the coil C relatively uniformly. When the coil C has been heated up to a given temperature (1150° to 1200° C.) and soaked, a cooling gas is blown into the furnace 1 through a cooling gas supply pipe 7 connected to the top thereof to complete annealing at a predetermined temperature. The heated cooling gas is cooled in a cooling device 8 and recirculated into the furnace 1.

Recently, methods to reduce the size and/or weight of transformers and other electric devices using unidirectional electrical steels has become an important issue. In order to permit such size and/or weight reduction, the magnetomotive force ($B_8$) and core loss of unidirectional electrical steels must be improved further.

The heat treatment methods the applicant proposed in Japanese Patent Applications Nos. 75,033 of 1980, 20,154 of 1981, 198,443 of 1981 and 96,740 of 1981 allows secondary recrystallization to proceed while heating coils of electrical steel at a given temperature gradient in a border region between the primary and secondary recrystallization regions. A coil of electrical steel that has undergone primary recrystallization annealing is heated from one end to the other so that secondary recrystallization is provided across the width of the coil. The heating is effected with a temperature gradient of 0.5° C./cm in a border region between the primary and secondary recrystallization regions within a temperature range of 930° to 1050° C. These methods have made it possible to manufacture electrical steels that are unprecedentedly excellent in terms of magnetomotive force and core loss.

In the conventional batch annealing furnaces, however, the entire volume of each coil is heated substantially uniformly as described previously. Accordingly, it is impossible to provide the required temperature gradient to the coil in said border region.

SUMMARY OF THE INVENTION

The object of this invention is to provide a batch annealing apparatus that is capable of heating metal coils at a given temperature gradient in a predetermined region.

A batching annealing apparatus according to this invention comprises a bell-shaped furnace, a base plate and an inner cover, with a bottom chamber which has an open top-end, an inside diameter slightly larger than the outside diameter of a metal coil to be heated therein, and a large enough space to accommodate the metal coil, provided below the furnace. Within the bottom chamber, there is coaxially provided a cylindrical stationary base that extends upward from the bottom thereof. The stationary base has a partition whose outside diameter is slightly smaller than the inside diameter of the metal coil that is positioned in the opening of the bottom chamber. The base plate is annular in shape and is provided with cooling means. The base plate is supported by a support member that is movable upwardly and downwardly through the bottom of the bottom chamber. The lower end of the support member is connected to an elevating drive.

In order to heat a metal coil at a given temperature gradient in a certain region using the batch annealing apparatus just described, the base plate loaded with the metal coil is lowered to place the coil in the bottom chamber. Then, the base plate is caused to ascend gradually. That portion of the metal coil which projects above the bottom chamber or enters the inner cover is heated by said heating means and undergoes secondary recrystallization. Secondary recrystallization, however, does not take place in the remaining portion of the metal coil within the bottom chamber in which primary recrystallization has already occurred. Said heating means, the ascending speed of the metal coil and the base plate cooling means are controlled so that a given temperature gradient is provided to the border region between the secondary and primary recrystallization regions or near that portion of the metal coil that is situated in the vicinity of the opening of the bottom chamber.

The batch annealing apparatus according to this invention has a bottom chamber, as described above, whose inside diameter is slightly larger than the outside diameter of the metal coil to be annealed therein, with a cylindrical stationary base having a partition whose outside diameter is slightly smaller than the inside diameter of the metal coil provided in the bottom chamber. Accordingly, the bottom chamber is separated from the hot inner cover by the metal coil and the partition of the stationary base, and thus the space in the bottom chamber is kept at a considerably lower temperature than the temperature in the inner cover. This permits providing said required temperature gradient in the border region as the metal coil is moved out from within the bottom chamber into the inner cover.

Cooling means provided on the base plate of the batch annealing apparatus of this invention keeps the metal coil within the bottom chamber at a low temperature, thereby providing a steep temperature gradient in said border region. It is also possible to adjust the temperature gradient to a desired value by controlling the level of cooling produced thereby.

DETAILED DESCRIPTION OF THE PREFERRED EMBODIMENTS

Figure 1:
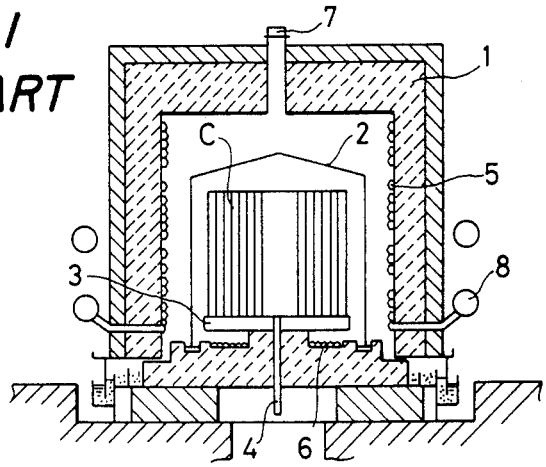
FIG. 1 PRIOR ART
FIG. 1 is a vertical cross section of an example of conventional batch annealing apparatuses.
Figure 2:
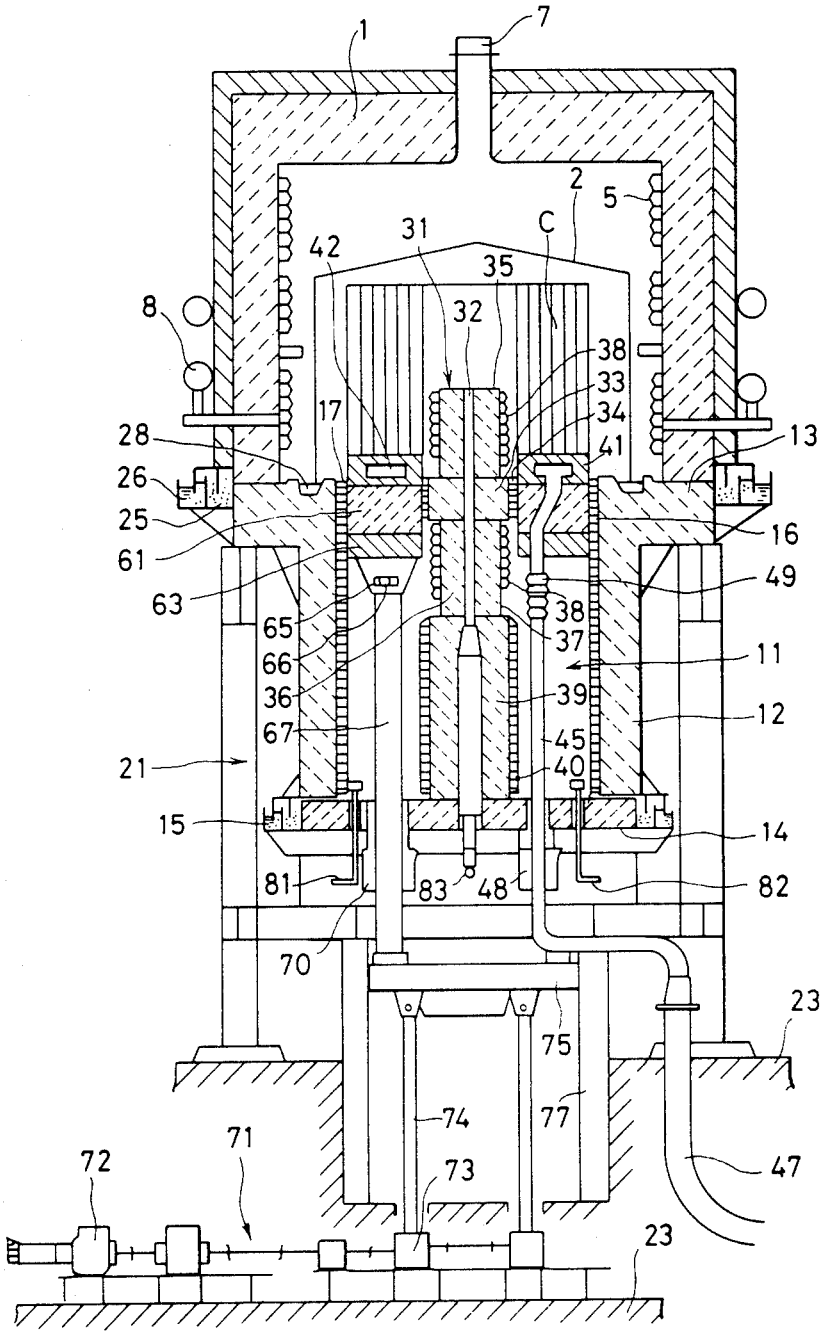
FIG. 2 is a vertical cross section of a batch annealing apparatus according to this invention.

FIG. 2 is a vertical cross section of a batch annealing apparatus according to this invention. In FIG. 2, parts which are similar to those of the conventional annealing apparatus shown in FIG. 1 are designated by similar reference numerals and no further description will be given to such parts.

A bottom chamber 11 is defined within a cylindrical body 12 having a flange 13 at the top end thereof and a bottom member 14, both being made of refractory bricks. The body 12 and bottom member 14 are made up of sections for easy disassembling and reassembling.

Figure 3:
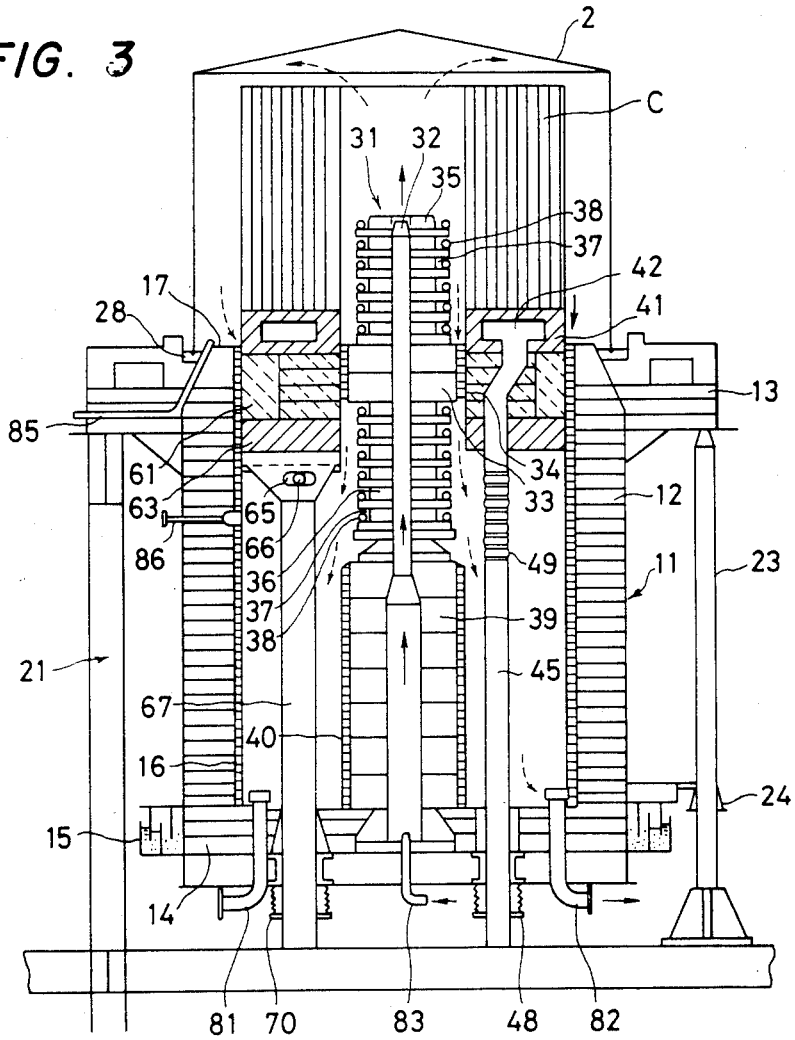
FIG. 3 is a detailed vertical cross section of part of the apparatus of FIG. 2 showing the principal parts of the apparatus shown in FIG. 2.

The flange 13 of the body 13 rests on the top of a supporting structure 21. As shown in FIGS. 2 and 3, the bottom member 14 is provided close to the lower end of the supporting structure 21. A sand seal 15 is provided between the body 12 and bottom member 14 in order to prevent the inflow of the atmosphere into the bottom chamber 11. As shown in FIG. 3, guide posts 23 (the figure shows only one of the guide posts 23) are fastened at intervals to the lower portion of the supporting structure 21. Guide links 24 on the external surface of the body 12 are fitted to the guide posts 24. The guide posts 23 and guide rings 24 together facilitate the positioning, raising and lowering of the body 12 in disassembling and reassembling. The internal surface of the body 12 is lined with a soft, resilient insulating material 16 (such as ceramic fiber block). The inside diameter of the body 12 lined with the insulating material 16 is slightly smaller than the outside diameter of the metal coil C, so that the external surface of the coil C slides in contact with the insulating material 16.

A furnace 1 is mounted on the flange 13, with a sand seal 25 and liquid seal 26 provided between the furnace 1 and bottom chamber 11 for air-tightness. An inner cover 2 is also mounted on the flange 13 and sealed with a sand seal 28.

In the bottom chamber 11, as shown in FIG. 3, there is provided a cylindrical stationary base 31 that projects upward from the bottom member 14 coaxially with the body 12. The stationary base 31 is made of refractory brick and has an atmospheric gas supply port 32 at the center. That portion of the stationary base 31 which corresponds to the opening 17 of the bottom chamber 11 constitutes a partition 33. The periphery of the partition 33 is lined with an insulating material 34 that is identical with the insulating material 16 on the internal surface of the body 12. The outside diameter of the partition 33 is slightly larger than the inside diameter of the coil C, so that the internal surface of the coil C slides in contact with the external surface of the partition 33. The upper end of the partition 33 is flush with the upper end of the bottom chamber 11. The portions above and below the partition 33 are somewhat smaller in diameter and constitute a first heating section 35 and a second heating section 36, respectively. The heating sections 35 and 36 are provided with a number of circular grooves 37 that accommodate an electric heater 38. The portion between the lower end of the second heating section 36 and the bottom member 14 constitutes a base section 39 that has the same diameter as the partition 33 and is lined with an insulating material 40 that is identical with the insulating material 16.

Figure 4:
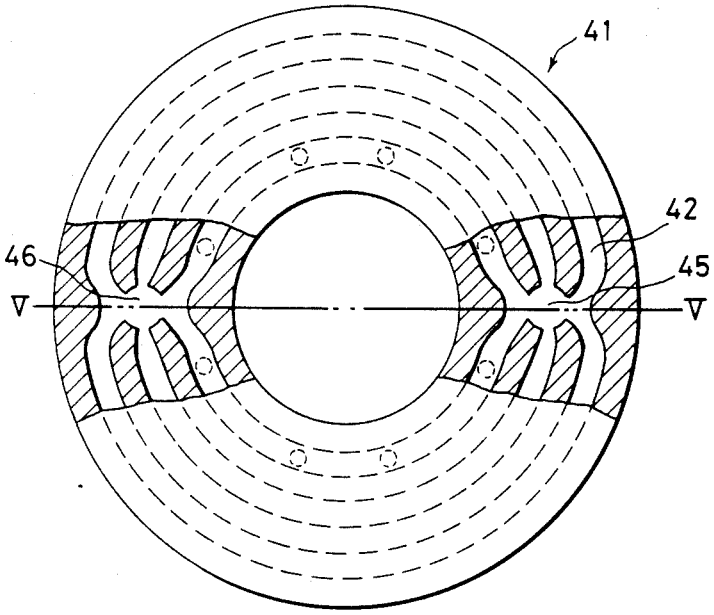
FIG. 4 is a plan view, partly in section, of a base plate in the apparatus shown in FIG. 2.
Figure 5:
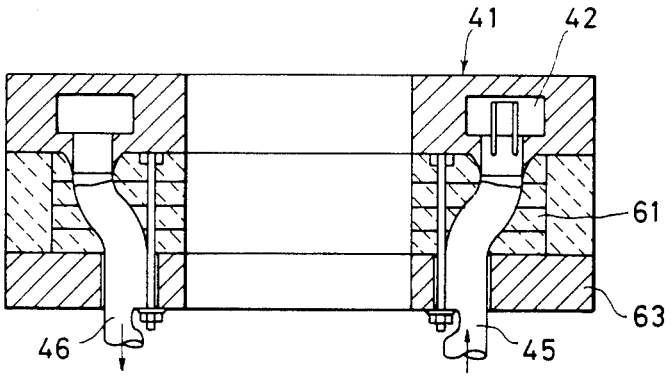
FIG. 5 is a cross-sectional view taken along the line V—V of FIG. 4.

A base plate 41 is provided which is annular in shape, with the inside diameter thereof being equal to or slightly smaller than the inside diameter of the coil C and the outside diameter thereof being equal to or slightly larger than the outside diameter of the coil C. Inside the base plate 41, as shown in FIGS. 4 and 5, for example, there are provided three circular cooling gas passages 42 that are radially spaced from each other. The cooling gas passages 42 communicate with a cooling gas supply pipe 45 and a cooling gas exhaust pipe 46 that is separated therefrom by an angular space of 180 degrees. Both pipes 45 and 46 pass through the bottom member 14 of the bottom chamber 11 and lead through a flexible tube 47 to a cooling gas circulating system 51 described later. Dynamic bellows 48 are provided where the two pipes 45 and 46 pass through the bottom member 14 of the bottom chamber 11 to keep the bottom chamber 11 airtight. Midway bellows 49 are also provided to the two pieps 45 and 46 so that thermal expansion that occurs while the apparatus is in operation is absorbed.

Figure 6:
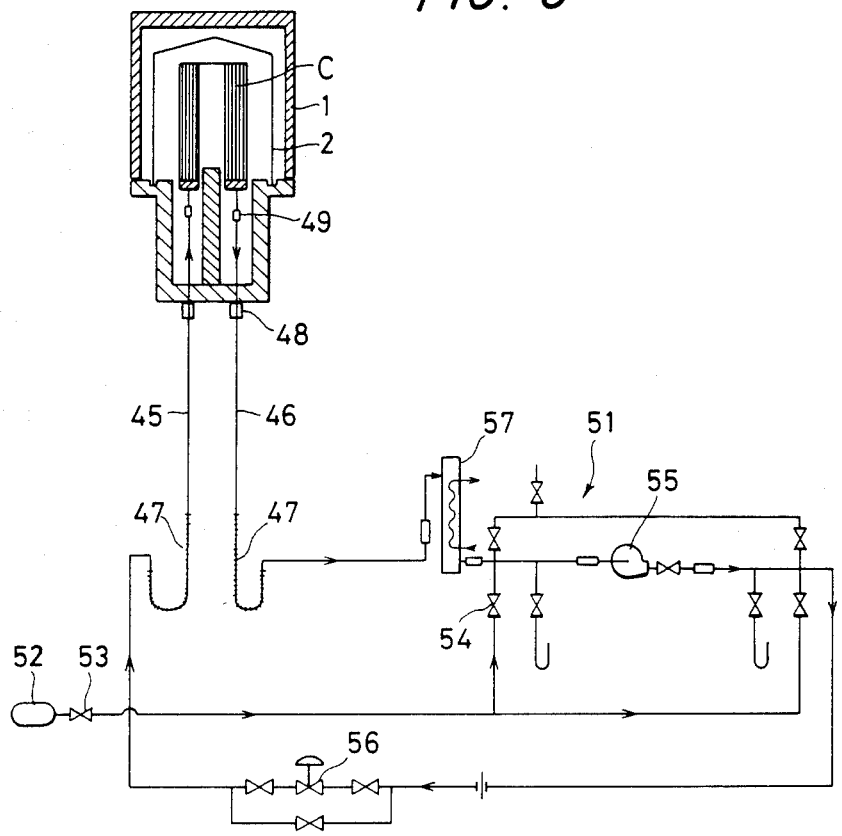
FIG. 6 is a flow diagram of a cooling gas circulating system used in the apparatus shown in FIG. 2.

FIG. 6 is a flow diagram of the cooling gas circulating system 51.

In the cooling gas circulating system 51, a blower 55 communicates with a cooling gas tank 52 through a supply valve 53 and a shutoff valve 54. The blower 55 communicates with said cooling gas supply pipe 45 via a flow or temperature control valve 56. The cooling gas exhaust pipe 46 communicates with the entry side of the blower 55 via a cooler 57.

Figure 7:
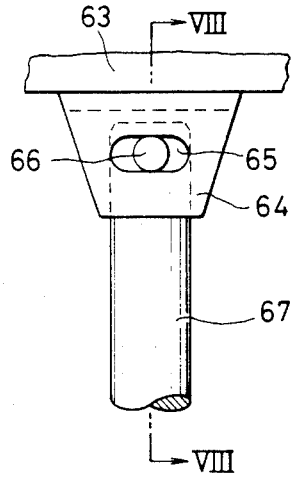
FIG. 7 is a detailed view showing how an intermediate member is coupled to a support in the apparatus shown in FIG. 2.
Figure 8:
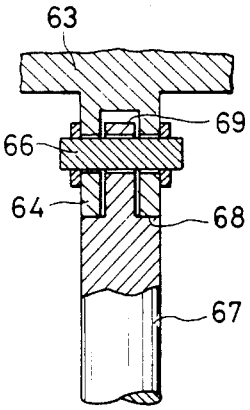
FIG. 8 is a cross-sectional view taken along the line VIII—VIII of FIG. 7.

The base plate 41 is supported by supports 67, with an annular insulating material 61 and an intermediate member 63 interposed therebetween. In order to absorb the thermal expansion of the base plate 41, a pair of projections 64 stick out downward from the bottom of the intermediate member 63 as shown in FIGS. 7 and 8. Each projection 64 is provided with a horizontal pin slot 65. A shoulder 68 is formed at the upper end of the support 67, upon which the projection 64 of the intermediate member 63 rests. With the upper end of the support 67 held between the paired projections 64, a coupling pin 66 is loosely fitted through said pin slot 65 and a pin hole 69 provided in the upper end of the support 67.

The lower portion of the support 67 passes through the bottom member 14 of the bottom chamber 11. Dynamic bellows 70 attached to this portion keeps the bottom chamber 11 airtight.

Figure 9:
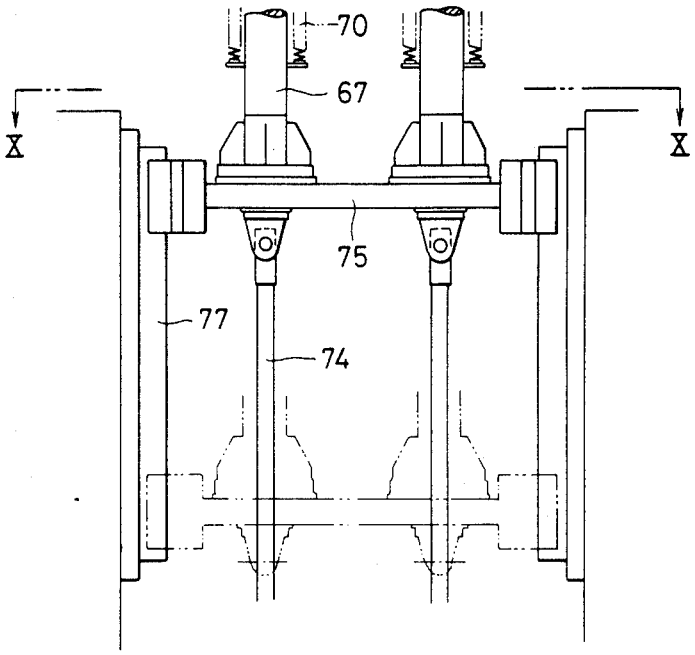
FIG. 9 is a front view of a guide mechanism of the apparatus shown in FIG. 2.
Figure 10:
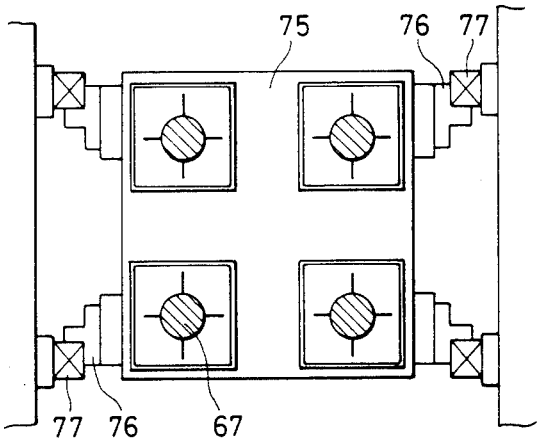
FIG. 10 is a cross-sectional view taken along the line X—X of FIG. 9.
Figure 11:
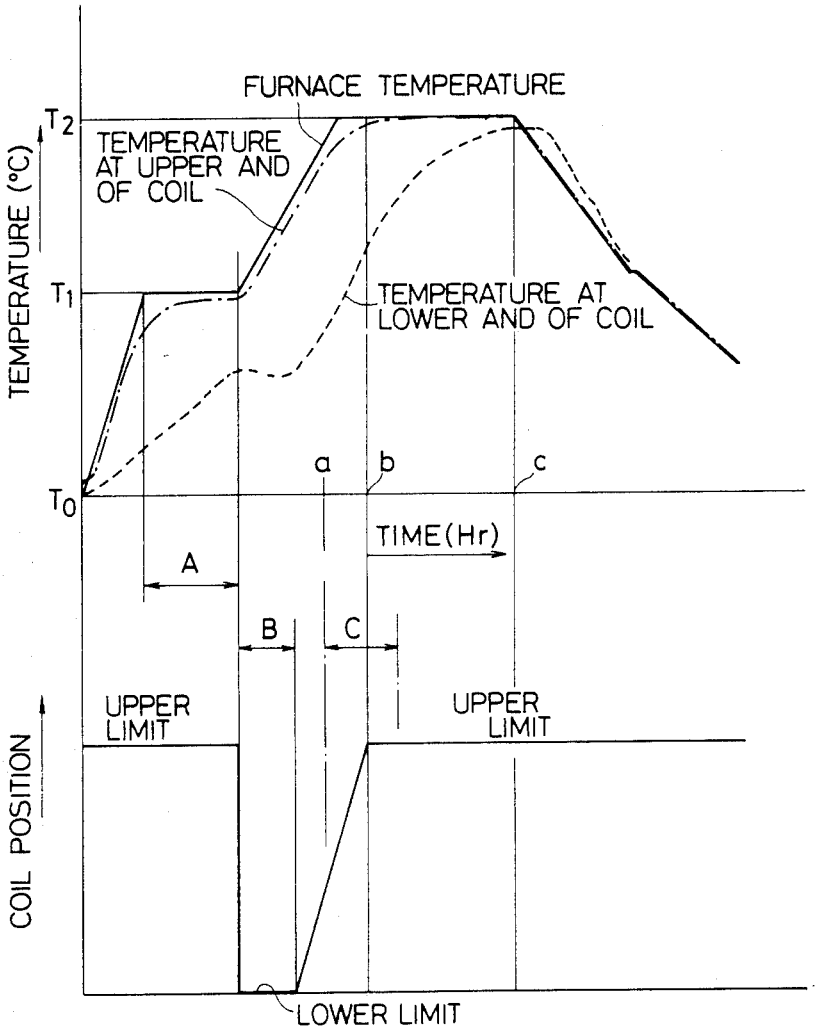
FIG. 11 is a diagram of how the furnace temperature, coil temperature and coil position change with time.

The base of the support 67 is coupled to an elevating device 71 equipped with a speed-reducible motor 72 and a screw jack 73 that is driven by said motor. The screw jack 73 is connected to a square base 75 via a vertical coupling rod 74. A pair of guides 76, each having an L-shaped guide surface, are fastened to both sides of the base 75 as shown in FIGS. 9 and 10. Vertical rails 77 corresponding to said guides 76 are fastened on the floor 23.

As shown in FIG. 3, a purge-gas supply pipe 81 and a purge-gas exhaust pipe 82 are attached to the bottom member 14 of the bottom chamber 11. An atmosphere gas supply pipe 83 is connected to the lower end of the atmosphere gas supply port 32 that passes through the stationary base 31. The flange 13 of the bottom chamber 11 has a pressure measuring port 85 that opens into the inner cover 2, while the body 12 has a pressure measuring port 86 opening into the bottom chamber 11.

Now a method of annealing a coil of electrical steel for secondary recrystallization using the batch annealing apparatus just described will be explained.

With the furnace 1 and inner cover 2 removed, the base plate 41 is set at the upper limit shown in FIG. 2. A coil of electrical steel C that has been annealed for primary recrystallization is placed on the base plate 41. Then, the coil C is covered with the inner cover 2, over which the furnace 1 is lowered. The space inside the furnace 1 and inner cover 2 are purged by the $N_2$ gas supplied from the cooling gas injection pipe 7 and the atmosphere gas supply port 32, respectively. The space inside the bottom chamber is purged with the $N_2$ gas that is supplied and discharged through the purge-gas supply pipe 81 and exhaust pipe 82.

When the purging is complete, the $N_2$ atmosphere gas in the inner cover 2 is heated up at a rate of, for example, 10°–70° C. per hour, by the electric heater 5 on the inside of the furnace 1. At this time, the electric heater 38 in the first heating section 35 of the stationary base 31 may also be used. When the atmosphere in the inner cover 2 has been heated from room temperature $T_0$ to a predetermined temperature $T_1$ (600°–650° C.), soaking is effected over a period A (10–20 hours). When the soaking is started, the $N_2$ atmosphere gas is replaced with AX gas. This soaking is carried out with the atmosphere gas at a given dew point (not higher than between −5° and −10° C.), whereby the moisture generated from a separator applied on the coil C is prevented from condensing when the coil C is cooled later.

When the soaking is complete, the elevating device 71 is actuated to bring the coil C down to the lower limit in the bottom chamber 11. In this position, the upper end of the coil C lies in the same plane as the upper end of the bottom chamber 11 and that of the partition 33 of the stationary base 31. The coil C is held inside the bottom chamber 11 for a period B in which the temperature at the upper end thereof exceeds 930° C. While the furnace temperature and the temperature at the upper end of the coil C rise during this period, the temperature of the lower portion of the coil C drops somewhat because the temperature in the bottom chamber 11, which is separated from the inner cover 2 by the coil C and partition 33, is low.

When the temperature at the upper end of the coil C has risen above 930° C. in the holding period B, the elevating drive 71 is actuated again to raise the coil C at a rate of 20–600 mm per hour. As the coil C ascends slowly from within the bottom chamber 11 into the inner cover 2, a temperature gradient arises in a border region between that portion of the coil C which is exposed to the atmosphere in the inner cover 2 and that portion which still remains inside the bottom chamber 11. The heating rate in the furnace and the ascending speed of the coil C are regulated so that the temperature gradient does not fall below 2° C./cm. When a relatively large portion of the coil C has entered the inner cover 2, the temperature of the remaining portion in the bottom chamber 11 also rises to such an extent that it is no longer possible to maintain the desired temperature gradient. The base plate 41 is cooled from time point a that is somewhat ahead of the point at which the desired temperature gradient becomes unattainable.

The base plate 41 is cooled by supplying the same gas as the atmosphere gas in the inner cover 2 from the cooling gas circulating system 51 to the cooling gas passage 42 therein through the cooling gas supply pipe 45. ($N_2$ gas also serves this purpose.) The gas supplied to the cooling gas passage 42 is heated up while cooling the base plate 41 and flows to the cooler 57 via the cooling gas exhaust pipe 46. The blower 55 forcibly sends the gas cooled in the cooler 57 back to the base plate 41. The temperature control valve 56 regulates the flow rate of the cooling gas in accordance with said temperature gradient in the border region.

With the coil C thus gradually heated downward from the upper end thereof, the ascent of the base plate 41 is temporarily stopped at time point b when the lower end of the coil C has cleared the bottom chamber 11. At this point, the temperature at the upper end of the coil C reaches a predetermined level $T_2$ (1150°–1200° C.). The cooling of the base plate 41 is continued until the temperature of the lower portion of the coil C rises above 930° C. (a period C). The atmosphere gas inside the inner cover 2 is changed from AX gas to $H_2$ gas when the furnace temperature reaches the predetermined level $T_2$.

The coil C is then soaked until the temperature at the lower end thereof reaches 1150° C. or above. When this soaking is complete (at time point C), cooling gas is blown through the cooling gas injection pipe 7 into the furnace 1 to cool the inner cover 2 and the coil C placed therein. When the coil C has been cooled to a predetermined temperature, the furnace 1 is removed to further cool the inner cover 2 and coil C in the atmosphere. On completion of the cooling, the inner cover 2 is removed to complete a cycle of the annealing operation.

While said heating and soaking are in progress, part of the atmosphere gas supplied into the inner cover through the atmosphere gas supply pipe 83 is allowed to leak into the furnace 1 through the sand seal 28 upon which the inner cover 2 rests. The pressures in the inner cover 2 and bottom chamber 11 are measured as required through the pressure measuring ports 85 and 86. Then, the pressure difference is adjusted so that the pressure in the inner cover 2 is equal to or slightly higher (by, for example, 0.5–1 mmAq) than the pressure in the bottom chamber 11. This adjustment prevents the atmosphere gas in the bottom chamber 11 that is kept at a lower temperature from flowing into the inner cover 2.

When the coil C is large-sized, the electric heater 5 in the furnace 1 may not be able to provide adequate heating to the portion of the coil C which is contained in the inner cover 2 and, therefore, the desired temperature gradient may not be achieved. On such occasions, supplementary heating is provided by use of the electric heater 38 in the first heating section 35 of the stationary base 31. When the entirety of the coil C is soaked at a temperature not lower than 1150° C., heat might radiate from the lower end of the coil C through the base plate 41. However, the radiation of heat is restrained by the hot base plate 41 and the heat-insulating material 61. Depending upon the size of the coil C, however, the radiation of heat may be such that it is no longer possible to keep the lower end of the coil C at the desired temperature. At such time, supplementary heating is provided by use of the electric heater 38 in the second heating section 36 of the stationary base 31.

Figure 12:
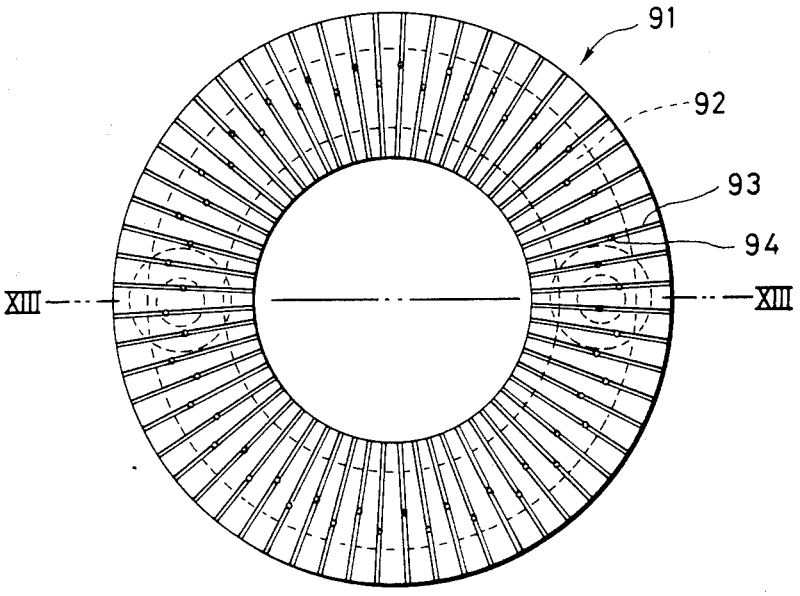
FIG. 12 is a plan view showing another embodiment of the base plate.
Figure 13:
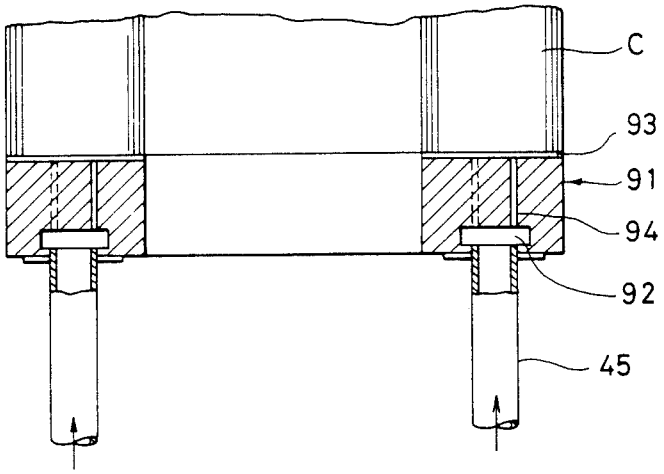
FIG. 13 is a cross-sectional view taken along the line XIII—XIII of FIG. 12.

FIGS. 12 and 13 show another embodiment of the base plate. This annular base plate 91 has an inside diameter that is equal to or slightly smaller than the inside diameter of the coil C and an outside diameter that is equal to or slightly larger than the outside diameter of the coil C. A circular gas passage 92 is provided in the bottom of the base plate 91. A number of radial grooves 93 are formed in the top of the base plate 91. The groove 93 is, for example, approximately 7 mm wide and 5 mm deep. Each groove 93 communicates with said gas passage 92 by a vertical hole 94.

The gas passage 92 communicates with the two gas supply pipes 45 that are separated from each other by an angular space of 180 degrees.

The base plate 91 is cooled by supplying the same gas as the atmosphere gas in the inner cover 2 from the atmosphere gas circulating system 51 into the gas passage 92 inside the base plate 91 via the gas supply pipe 45. The gas supplied to the gas passage 92 flows into the bottom chamber 11 through the hole 94 and groove 93. The gas cools the base plate 91 and the lower portion of the coil C during this travel. Part of the atmosphere gas that has entered the bottom chamber 11 flows to the cooler 57 through the gas exhaust pipe 46. The blower 55 forcibly sends the gas cooled in the cooler 57 back to the base plate 91. The temperature control valve 56 regulates the flow rate of the cooling gas in accordance with the temperature gradient described previously. The flow rate of the cooling gas is as small as, for example, 700 l/min.

In this embodiment, hot atmosphere gas is introduced from within the inner cover 2 (or the bottom chamber) into the base plate 91, which gas is then, upon being cooled, allowed to flow out through the grooves 93 at the top of the base plate 91. With the upper surface of the base plate 91 thus cooled, a steel temperature gradient develops in said border region.

When the upper surface of the base plate 91 is heated to a high temperature that differs widely from the temperatures in other portions, thermal stress might develop there. Then, if the base plate 91 subjected to such thermal stress is used repeatedly, cracks might develop that would lead to the breakage of the base plate 91, the leakage of the atmosphere gas and other troubles. By contrast, the base plate 91 according to this invention minimizes said temperature difference and, therefore, prevents the occurrence of cracks because provision is made to allow the atmosphere gas to flow out through the grooves 93 at the top thereof. Accordingly, this permits lengthening the service life of the base plate even if it is not made of high-quality materials with high strength at high temperatures.

Figure 14:
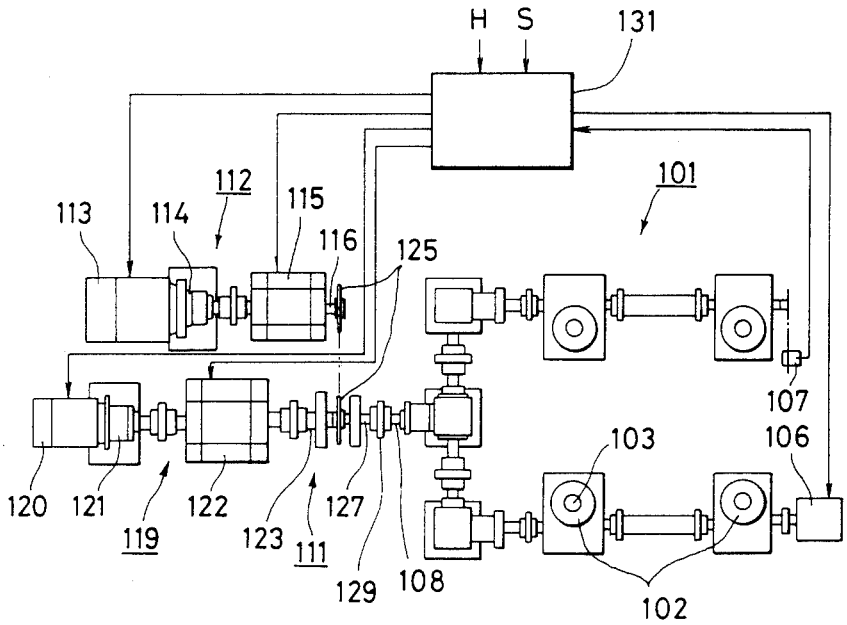
FIG. 14 is a plan view showing another embodiment of an elevating drive.

FIG. 14 shows another embodiment of the elevating drive. The base of the support 67 is coupled to an elevating drive 101. The elevating drive 101 is equipped with a screw jack 102 which is connected to a vertical coupling rod 103. The coupling rod 103 is connected to the square base 75 (see FIG. 9) as described previously.

The screw jack 102 is connected to a brake 106 and a contactless switch 107 that detects the displacement of the metal coil C or the coupling rod 103.

A drive 111 that drives the elevating drive 101 comprises a high-speed drive 112 and a low-speed drive 119. The former is made up of an AC motor (5.5 kw and four-pole) 113, a cyclo reducer (reduction ratio=1/6) 114 and a clutch 115. The latter comprises an AC motor (1.5 kw and four-pole) 120, a cyclo reducer (reduction ratio=1/87) 121 and a clutch 122. The output shaft 116 of the clutch 115 and the output shaft 123 of the clutch 122 are coupled together by means of a chain transmission 124, and the output shaft 127 and the input shaft 108 of the elevating drive 101 are coupled together via a gear coupling 129.

The following describes how the elevating drive 101 is driven to raise and lower the coil C during the annealing cycle.

Figure 15:
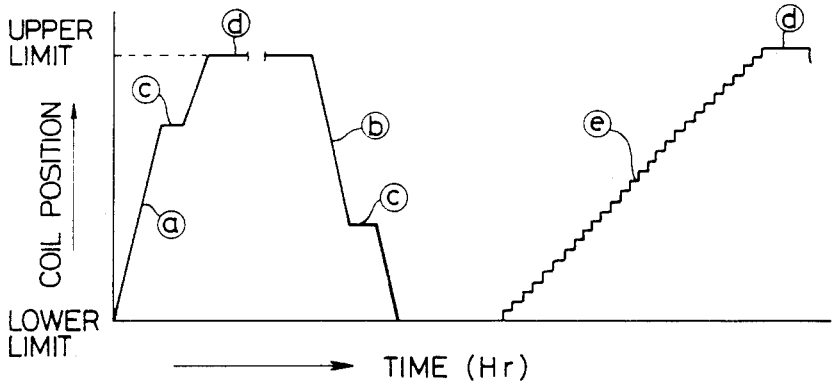
FIG. 15 is a diagram of the operation of the elevating drive shown in FIG. 14.

Table 1 and FIG. 15 show the ascending and descending condition of the coil C.

TABLE 1

| | High-speed Drive | | | | Low-speed Ascension ⓔ | |
|---|---|---|---|---|---|---|
| | Up ⓐ | Down ⓑ | Short Stop ⓒ | Long Stop ⓓ | Up | Stop |
| Low-speed ascension AC motor 120 | Off | Off | Off | Off | On | On |
| Low-speed ascension clutch 122 | Disconnected | Disconnected | Disconnected | Disconnected | Connected | Disconnected |
| High-speed drive AC motor 113 | On (Forward) | On (Reverse) | Off | Off | Off | Off |
| High-speed drive clutch 115 | Connected | Connected | Disconnected | Disconnected | Disconnected | Disconnected |
| Brake 106 | Open | Open | Closed | Closed | Open | Closed |

As shown in Table 1 and FIG. 15, the high-speed drive AC motor 113 works only when the coil is raised, whereas the low-speed drive AC motor 120 works even while the coil comes to a standstill during the low-speed ascension period. This is because the ascending speed of the coil is controlled by connecting and disconnecting the clutch 122. The coil C, therefore, moves upward intermittently. By changing the ratio between the ascending and pausing time of the coil C, the ascending speed thereof can be varied over a wide range (for example, between 20 mm/hr and 600 mm/hr).

As shown in FIG. 14, a control device 131 is provided for controlling the AC motors 113 and 120, clutches 115 and 122, and brake 106 to function as shown in Table 1 and FIG. 15 based on the heating pattern H, coil size S and other settings and signals from the noncontact switch 107.

By providing the elevating drive driven by the low- and high-speed motors, the embodiment just described makes it possible to dispense with a costly transmission that would also take up a large space. When moving the metal coil up at low speed, the ascending speed can be controlled by connecting and disconnecting the clutch coupled to the low-speed ascension motor. This permits controlling the ascending speed over a wide range.

This invention is not limited to the specific embodiments described in the foregoing. For example, the electric heater 5, which serves as heating means, may be replaced with a direct-firing burner. Heating means may be provided not only on the wall of the furnace 1 but also on the ceiling thereof. For cooling the base plate 41, a cooling pipe may be provided on the top of the insulating material 61, in place of the cooling gas passage 42. The disk-shaped bottom member 14 of the bottom chamber 11 may be divided midway in the bottom chamber 11, in which case the bottom member becomes bowl-shaped. The sand seal 15 may be replaced with a press-type seal of ceramic fiber or other similar material, a fastening seal using a gasket, or either or both of them combined with a liquid seal. The heat-insulating materials 16, 34 and 40 fastened to the bottom chamber 11 and stationary base 31 and the electric heater 38 attached to the stationary base 31 are not absolutely indispensable. If the heat-insulating materials 16 and 34 are not provided, the clearance between the internal surface of the bottom chamber 11 and the periphery of the coil C and the clearance between the periphery of the partition 33 and the internal surface of the coil C may be reduced to such an extent (for example, 1–5 mm) that the inflow of the high-temperature atmosphere gas from the inner cover into the bottom chamber 11, which would raise the temperature in the bottom chamber above the tolerable limit, is prevented. The support 67, which is exposed to intense heat, may be made of a pipe provided with water cooling on the inside and a heat-insulating cover on the outside. The support 67 may be also made of plain carbon steel rather than heat-resisting stainless steel. A hydraulic jack may be used with the elevating drive 71 in place of the speed-reducible motor 72 and screw jack 73.

What is claimed is:

1. A batch annealing apparatus for annealing a metal coil, comprising:

a bell-shaped furnace having heating means on the inside of the wall thereof;

a flange around the bottom of said furnace on which said furnace is detachably mounted and having a central opening therein having an inside diameter for permitting the coil to pass snugly thereby;

a detachable inner cover detachably mounted on said flange for covering a metal coil to be annealed and which is positioned in said furnace with the axis thereof vertical;

a bottom insulating chamber extending downwardly from said flange and having a closed bottom for isolating the interior thereof from the surrounding atmosphere and further having an inside diameter of a size for accommodating the metal coil therein and having said flange on the upper end thereof;

a cylindrical stationary base extending axially upwardly from the bottom of said bottom chamber into said inner cover and having a horizontal partition thereon at a point substantially corresponding to the level of said flange to define an annular opening therewith, the partition having an outside diameter for permitting the inside diameter of the metal coil to pass snugly thereby;

an annular base plate having a size for just fitting said annular opening and having cooling means operatively associated therewith;

an elevatable supporting means passing through the bottom of said bottom chamber in sealing engagement therewith and on which said base plate is mounted; and speed controllable elevating means connected to said supporting means.

2. The combination according to claim 1 further comprising a soft resilient refractory material on the internal surface of said bottom chamber and the external surface of said stationary base and along which said base plate slides.

3. The combination according to claim 1 in which said bottom chamber comprises an annular body and a bottom member, said body being detachable from the bottom member, and sealing means between said body and said bottom member.

4. The combination according to claim 1 further comprising heaters on the periphery of the portion of the stationary base which is above said partition and the portion which is inside said bottom chamber.

5. The combination according to claim 1 further comprising heaters on the periphery of the portion of the stationary base which is above said partition.

6. The combination according to claim 1 further comprising heaters on the periphery of the portion of the stationary base which is below said partition.

7. The combination according to claim 1 in which said base plate has an annular cooling gas passage therein, and said cooling means is a cooling gas circulating system connected to said gas passage and having a cooling gas flow control valve and a gas cooler therein.

8. The combination according to claim 1 in which said supporting means comprises an elevatable support extending through the bottom of said bottom chamber and an intermediate member disposed between the upper end of said support and said base plate, the upper end of said support and the intermediate member having coupling means for horizontally displaceably coupling them.

9. The combination according to claim 8 further comprising a base to which the lower end of said support is coupled, said base being connected to said elevating means, and vertical guiding means for guiding said base in vertical movement.

* * * * *